United States Patent [19]

Krohmann et al.

[11] 4,239,101

[45] Dec. 16, 1980

[54] QUICK CHANGE APPARATUS FOR GUIDE ROLLERS

[75] Inventors: Walter Krohmann, Riegelsberg; Ewald Gilles, Rheinberg, both of Fed. Rep. of Germany

[73] Assignee: Mannesmann Demag A.G., Duisburg, Fed. Rep. of Germany

[21] Appl. No.: 972,867

[22] Filed: Dec. 26, 1978

[30] Foreign Application Priority Data

Dec. 24, 1977 [DE] Fed. Rep. of Germany ..... 2757953

[51] Int. Cl.[3] ..... B65G 39/00

[52] U.S. Cl. ..... 193/37; 29/283; 198/780

[58] Field of Search ..... 193/37, 35 R, 35 C; 198/780; 308/237 R, 237 A, 20; 29/116 R, 116 AD, 282, 283, 252, 250; 72/238, 239; 226/190, 194

[56] References Cited

U.S. PATENT DOCUMENTS

| | | | |
|---|---|---|---|
| 2,385,000 | 9/1945 | Hoke | 29/283 |
| 3,340,036 | 9/1967 | Dryon | 193/37 X |
| 3,730,329 | 5/1973 | Sturdy et al. | 198/780 |
| 3,853,214 | 12/1974 | Vinarcsik | 198/780 |
| 4,030,183 | 6/1977 | Smola | 29/252 |
| 4,034,837 | 7/1977 | Vinarcsik | 198/780 X |

*Primary Examiner*—Robert B. Reeves
*Assistant Examiner*—Gene A. Church
*Attorney, Agent, or Firm*—Mandeville and Schweitzer

[57] ABSTRACT

A means for quickly placing a roller set onto a supporting shaft is disclosed. Generally, a guide sleeve is mounted at one end of the shaft and formed whereby the upper surfaces of the sleeve provide an aligned continuation of the upper surface of the supporting shaft. The remaining portions of the sleeve surface taper inwardly away from the imaginary continuation of the shaft surface. Thus, the sleeve has a diameter somewhat less than the outer diameter of the supporting shaft and accordingly, less than the inner diameter of the roller set. This arrangement facilitates a slipping of the roller set onto the guide sleeve without a need for precisely aligning the roller set with respect to the guide sleeve. The configuration of the upper surfaces of the sleeve insures the proper alignment of the roller set with the supporting shaft. Once the roller set is placed onto the guide sleeve, it may then be easily slipped from the sleeve and onto the shaft.

3 Claims, 3 Drawing Figures

QUICK CHANGE APPARATUS FOR GUIDE ROLLERS

BACKGROUND AND SUMMARY OF THE INVENTION

The invention relates to a device for quickly exchanging guide rollers or guide roller sets on and off supporting shafts of a roll mill train.

In the cold alignment of profiles on roller aligning machines, it is always desirable to exchange the guide rollers in as short a time period as possible. When preparing the roll mill train for a new profile, the rebuilding period of the aligning machine should under no circumstances exceed the time required for the operation of the roll mill train itself. Depending upon its design, a roller aligning machine is provided with between 7 and 11 supporting shafts. The guide rollers of each shaft are assembled by means of a flange bushing and locking nut to make up a roller set. A key spring connection serves as torsion safeguard between the shaft and flange bushing. To rearrange the roller aligning machine with a new profile, all roller sets must be withdrawn from their respective shafts and replaced with new roller sets.

It is well known in the art to exchange the guide roller sets by means of a crane with the assistance of wire cables, pliers or similar devices. Due to the very high hoisting speed of rolling mill hangar cranes, cranes with extremely low hoisting speeds are used, which are specially installed for the purpose of changing guide rollers at the roller aligning machines. However, despite the favorable operating features of such cranes, the alignment of a roller set with the central axis of the supporting shaft to facilitate slipping the set onto the shaft is very time-consuming. This is especially true in view of the fact that the clearance between the supporting shaft and the flange bushing is in the order of a few tenths of a millimeter, and a roller set may weigh up to 7 tons.

It is also known to utilize rail as well as freetraveling devices equipped with several horizontally disposed mandrels arranged opposite the supporting shafts. A mandrel of this device must be brought before a supporting shaft in exact alignment if a roller set is to be slipped from the supporting shaft onto the mandrel or vice versa. Due to the narrow clearances, this, too, is a very time-consuming procedure. Furthermore, the devices mentioned require a great deal of floor space and are expensive. Accordingly, their use is generally limited to new plants since there is usually not enought space in existing plants to include an additional roller exchange device.

It is a primary objective of the present invention to provide a device of the crane type to quickly and easily exchange guide rollers in a roll mill train. The apparatus disclosed herein may be installed in already existing plants with a minimum space requirement. Generally, the present invention is characterized by a centering sleeve-like member mounted on a free frontal face of the support shaft and arranged and configured whereby the upper surface thereof for about 45° on either side of the center vertical is an aligned continuation of the support shaft shell surface. The remaining surfaces of the member converge radially inwardly from the imaginary projection of the shaft shell surface. In this manner, the axial spread of the member approximately matches the breadth of the guide roller or guide roller set. The guide roller set may be easily slipped onto the centering sleeve by any hangar crane. Since the outer dimension of the sleeve member is reduced relative to the support shaft, it is not necessary to suspend the roller set from the crane either exactly horizontal or exactly aligned with the support shaft. After slipping the roller set onto the centering sleeve, the set is in exact alignment with the support shaft and can be easily pushed onto the latter. The time-consuming alignment of the roller set with the support shaft is thus eliminated.

In accordance with another feature of the invention, the sleeve member may be equipped with a key spring aligned with the key spring of the support shaft. The key spring of the guide member is formed to be of a width equal to the key spring of the support shaft and includes lateral faces which converge in the radial direction. When mounting the guide rollers or the guide roller set, the conicity of the sleeve key spring provides sufficient clearance to slip the roller set easily onto the support shaft.

Slipping the roller set onto the support shaft or, in reverse, the withdrawal of the set from the support, may be done in a variety of ways. For example, light roller sets may be changed by hand, while heavier ones can be lifted by means of hydraulic or mechanical devices incorporated in the aligning machine, or by the crane itself.

DETAILED DESCRIPTION OF A PREFERRED EMBODIMENT OF THE INVENTION

Figure 1:
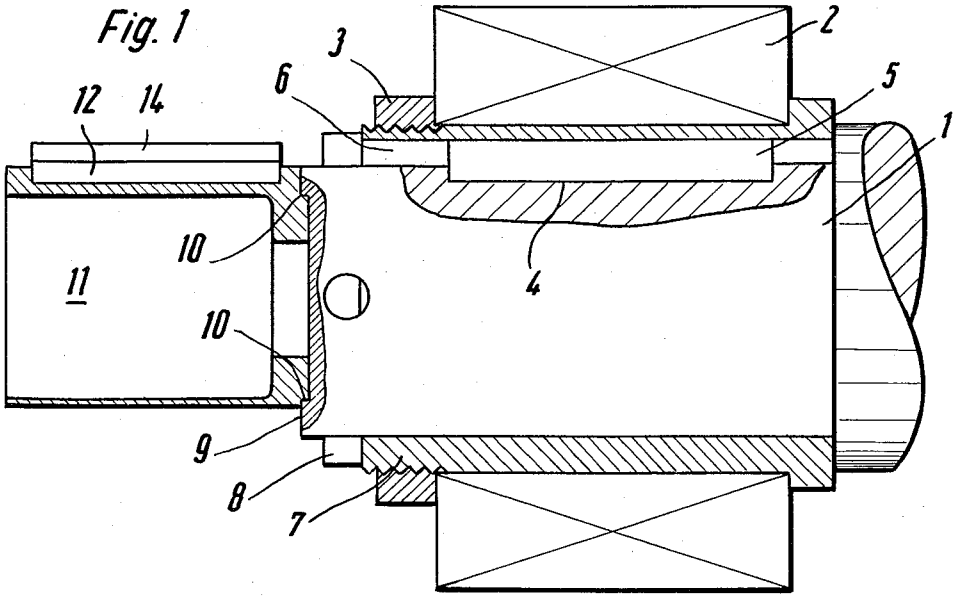
FIG. 1 is a side cross-sectional view of a roller set mounted on a supporting shaft including a guide sleeve built in accordance with the teachings of the present invention.
Figure 2:
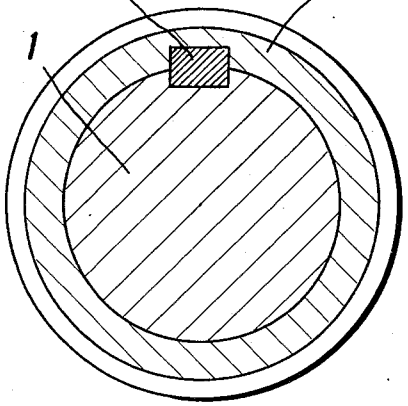
FIG. 2 is an end cross-sectional view of a roller set and supporting shaft arrangement.

Referring now to the drawings, the reference numeral 1 represents a support shaft of a conventional roller aligning machine (not shown). The guide roller is preassembled on a flange bushing 7 and secured against axial displacement by means of a nut 3. The roller set 2, 3, 7 is slipped onto the support shaft 1 and secured against axial displacement by a ring member 8.

To prevent relative rotation between the roller set 2, 3, 7 and support shaft 1, a key spring 5 on the shaft 1 is fitted into a key 6 arranged along the inner circumference of the flange bushing.

Figure 3:
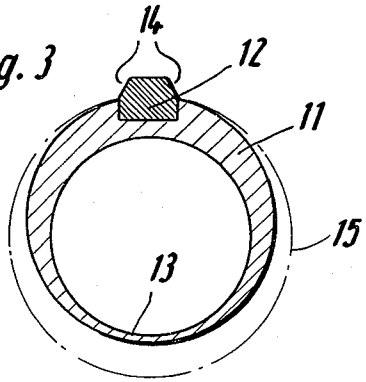
FIG. 3 is an end cross-sectional view of the guide sleeve of FIG. 1.

In accordance with the invention, a guide sleeve 11 is mounted on a front face 9 of the support shaft 1. To precisely align the guide 11 with the axis of the shaft 1, the front face 9 is provided with a centering shoulder 10. Referring now to FIG. 3, the upper portion of the shell surface of the sleeve 11 is arranged as an aligned continuation of the surface of the shaft 1. The remaining portions of the sleeve 11 converge radially inwardly whereby its circumference is recessed from the circumference defined by the projected configuration of the shaft surface, indicated by the dotted line 15. A key spring 12 is arranged in the guide sleeve 11 and has a width equal to that of the key spring 5 mounted in a key 4 of the support shaft 1. The spring 12 matches the width of the spring 5 of the support shaft 1 only in the lower portions thereof. The lateral faces 14 of the spring 12 converge toward one another and the sleeve 11 is mounted whereby the springs 5 and 12 are axially aligned.

To install the guide roller set 2, 3, 7 it is only necessary to slip the set onto guide 11 by means of a crane. This is a rather straightforward operation inasmuch as the outer diameter of the sleeve 11 is much smaller than the inner diameter of the guide roller set 2, 3, 7. The design of the guide 11 in the upper area is such that the roller set aligns itself automatically with the shell surface of the shaft 1, while the alignment of springs 5, 12 insure that the key 6 of the roller set is properly positioned with respect to the spring 5. The tapered surfaces 14 of the spring 12 also facilitate the installation of the roller set onto the support shaft.

We claim:

1. In a roll mill train, including supporting shafts and roller means mounted on each of said shafts, means to align each roller means with respect to a complementary supporting shaft to facilitate placement of the roller means onto the shaft, which comprises (a) a guide sleeve mounted to one free end of each supporting shaft, a limited area of a portion of each guide sleeve being generally congruent with an adjacent portion of the complementary supporting shaft whereby said limited area forms a partial extension of said complementary supporting shaft, and (c) the remaining portions of each guide sleeve being radially, inwardly offset from the remaining portions of the complementary supporting shaft whereby said remaining portions lie within the cylindrical surface defined by the imaginary projected configuration of the supporting shaft.

2. The guide means of claim 1, further characterized by (a) a portion of the guide sleeve forming a continuation of said shaft surface extending through an arc forming an angle of approximately 45° on either side of a vertical reference plane passing through the center axis of the sleeve.

3. The guide means of claim 1, further characterized by (a) a first key spring mounted on said supporting shaft, (b) a second key spring mounted on said guide sleeve and axially aligned with said first key spring, (c) the lower portion of said second key spring being equal in width to the width of said first key spring, and (d) the upper portion of said second key spring including lateral surfaces tapered inwardly.

* * * * *